US005497880A

United States Patent [19]

Dieffenbach

[11] Patent Number: 5,497,880

[45] Date of Patent: Mar. 12, 1996

[54] CABLE TRANSPORT CONTAINER

[76] Inventor: Erich A. Dieffenbach, 185 Waite Rd., Boxborough, Mass. 01719

[21] Appl. No.: 377,371

[22] Filed: Jan. 24, 1995

[51] Int. Cl.[6] ..... B65D 85/04

[52] U.S. Cl. ..... 206/395; 206/388; 206/702

[58] Field of Search ..... 206/388, 702, 206/395, 45.18; 211/70.1, 118; 248/51, 58, 63

[56] References Cited

U.S. PATENT DOCUMENTS

| | | | |
|---|---|---|---|
| 3,266,175 | 8/1966 | Palumbi | 206/45.18 |
| 3,664,719 | 5/1972 | Berg | 206/388 |
| 3,837,448 | 9/1974 | Hagstrom | 191/12.4 |
| 3,930,702 | 1/1976 | Pichowicz | 312/245 |
| 4,029,206 | 6/1977 | Mykleby | 206/400 |
| 4,475,649 | 10/1984 | Haarbosch | 206/328 |
| 4,863,020 | 9/1989 | Klemow | 206/702 |
| 4,878,586 | 11/1989 | Bancroft et al. | 206/702 |
| 5,033,619 | 7/1991 | Garis | 206/388 |
| 5,139,208 | 8/1992 | Schooley | 242/85.1 |

*Primary Examiner*—Jimmy G. Foster
*Attorney, Agent, or Firm*—David L. Baker; Rhodes & Ascolillo

[57] ABSTRACT

A carrying case for wire and cable that includes a removable top and bottom with sides, front and back hinged at three junctions and latched at the forth. The case opens to form a linear sheet exposing six wire supporting hooks. In the closed condition two groups of three hooks are end abutting and top wall abutting thereby preventing the cable from leaving the hook in the event the case is tumbled about.

11 Claims, 2 Drawing Sheets

CABLE TRANSPORT CONTAINER

BACKGROUND OF THE INVENTION

1. Field of the Invention

The invention relates generally to the broad field of containers and within that field the area of containers for wife and cable.

2. Description of the Prior Art

The relatively recent reduction in the size of electronic components in systems of all descriptions has increased their portability and with that the need to provide a means to package not only the components but the ancillary and supporting equipment that accompanies the main components. In particular, the cables that connect the components of any system may easily constitute more of a transportation problem than the components themselves. In the sports industry alone, the television cable necessary to wire a stadium for a football game could be measured in miles. Similarly, events like press conferences and court hearings require large quantities of cable. One of the most cable intensive uses of relatively short in length but high in piece count is with the rock and roll band. Each musician has either a microphone or his instrument is wired to an amplifier with enough slack to allow him to move freely about the stage. Cables often extend from the stage to any number of speakers that might surround the audience.

The above are just a few examples of situations where technicians are required to transport cable to a site, prepare the system for the event and then after the event break everything down, repackage and move on to the next job. Experience shows that more often than not, the cable is coiled wrapped and thrown into the back of a van style truck. On occasion the van has hooks on the inside wall panel where at least some of the wire is stored. In any event, the wire is still removed and carried to a site where it is usually deposited on the floor with the other tools and equipment. The cable must then be sorted and organized when it is ready to be installed.

Some U.S. Patents that have been awarded as a result of inventors efforts to solve the problem of transporting and organizing wires and cables include the following: U.S. Pat. No. 3,837,448 issued Sep. 24, 1974 to Hagstrom for a spool and hand grip for winding extension cord. The spool remains part of the cord and contains multiple electrical outlets. U.S. Pat. No. 3,930,702 issued Jan. 6, 1976 to Pichowicz shows a jewelry cabinet in the style of a box containing pegs for hanging jewelry. U.S. Pat. No. 4,029,206 issued Jun. 14, 1977 to Mykleby discloses a protective cover for a spool of cable wire stored in a well known and conventional manner. U.S. Pat. No. 4,475,649 issued Oct. 9, 1984 to Haarbosch for a stowage case for electrical cord where the excess cord is folded and stored in the small container. A storage rack for flexible cord is shown in the U.S. Pat. No. 5,139,208 granted to Schooley on Aug. 18, 1992.

The prior art described fails to solve the problems of effectively transporting and organizing a number of cables or wires for high use situations.

SUMMARY OF THE INVENTION

The invention is directed toward a carrying case that is handled in a manner similar to a piece of luggage and opened by unfolding into a linear panel with cables supported by hooks that keep the cables organized in the container regardless of orientation.

The container is of a size that will allow it to be carried by a top mounted hand grip when loaded. The front, back and side walls are hinged at three junctures and joined with a locking catch on the fourth. The top and bottom walls contain a groove that the hinged walls engage and are secured with latching catches. The interior of the container has hooks for supporting coiled cable, which are end abutting and top abutting. This feature locks the cable on the hook once the top is in place. Cable separators may be added to the hooks in the form of flexible doughnut shaped dividers that will slide on the horizontal member providing additional organization on each hook. The bottom wall contains protective feet that will tend to cause the container to remain on a floor or table and resist movement when placed in a location.

It is therefore an object of the invention to provide a new and improved container for storing and transporting wire and cable.

It is another object of the invention to provide a new and improved transport container for wire and cable that is light in weight and easily moved.

It is a further object of the invention to provide a new and improved transport container for wire and cable that prevents entanglement of the wire within the container despite container orientation.

It is still another object of the invention to provide a new and improved storage and transport container that provides easy and organized access to wire and cable stored therein.

It is another object of the invention to provide a new and improved storage and transport container which is of a durable and reliable construction.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF A PREFERRED EMBODIMENT

Figure 1:
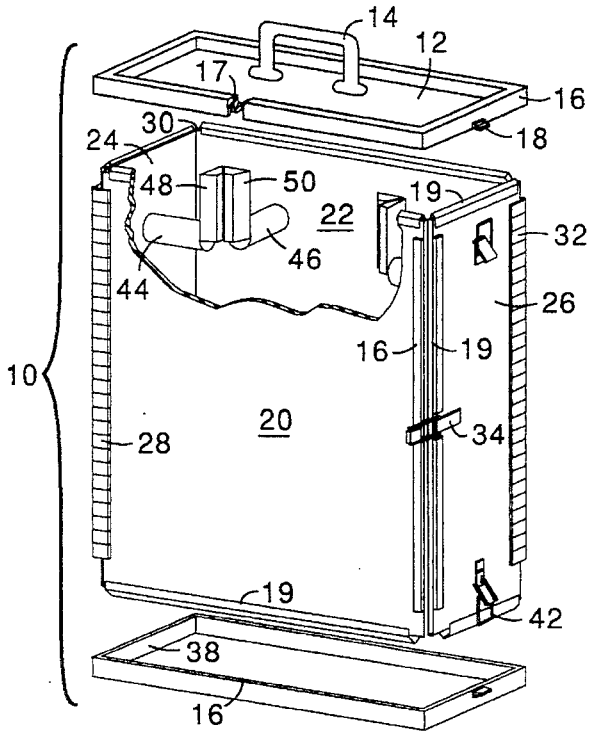
FIG. 1 is a perspective view partly exploded of the invention.

Referring now to FIG. 1, the container is shown generally at 10. The top wall 12 contains a handle, which may be of a typical luggage design but sturdy enough to support the weight of a container filled with cable. Edging 16 is provided with a groove 17 which will engage mating wall member 19 and stabilize the walls of the container. The top wall is releasably secured to the end walls by a latch mechanism of which catch 18 is a part. The front and rear walls 20,22 are flexibly connected to side walls 24,26 at three junctures by continuous hinges 28,30, and 32. The forth juncture is connected by lockable latch 34 which is protected by the edging system formed by members 16 and 19. The bottom wall 38 contains a perimeter of protective edging 16 which mates with edging member 19. Front, rear and side walls sit within the protective edging system which also provides support and stabilization to the large walls. The bottom wall is secured to the said walls by a lockable latch 42 on each end. Within the container are a plurality of hooks including dowels 44,46 which engage the walls of the container and hook members 48 and 50 on the ends of the dowels which abut with each other and in addition abut with the top wall.

When the container is in the closed configuration, the coiled wire is held secure by the hooks abutting each other and also abutting the top wall. Regardless of container orientation the cables or wire will not come free of the hooks no will the wire from one coil become entangled with the wire from another coil.

Figure 2:
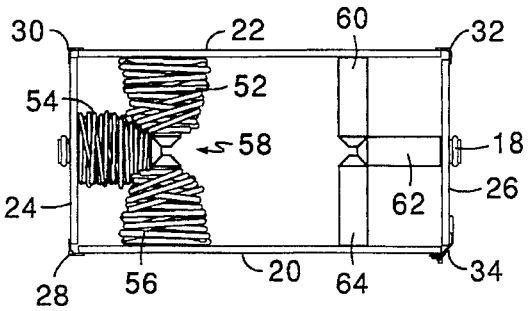
FIG. 2 is a top plan view of the invention with the top wall removed.
Figure 3:
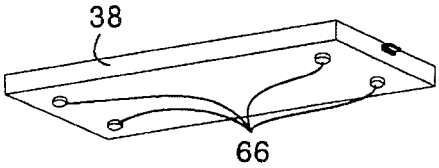
FIG. 3 is a perspective view of the bottom wall.

FIG. 2 shows the container with the top wall removed. The top wall is secured to the walls by lockable latch mechanism 18. As shown, the hooks on one end contain wire coils 52, 54 and 56 with the abutting hooks shown generally at 58. The hooks also abut the removed top wall thus preventing the cable from dislocating from the hook. Hooks 60,62,64 are shown without wire in order to clearly display their relative positions. FIG. 3 shows the feet 66 used on the outside of the bottom wall to resist movement of the container when not in the process of being moved from one location to another.

Figure 4:
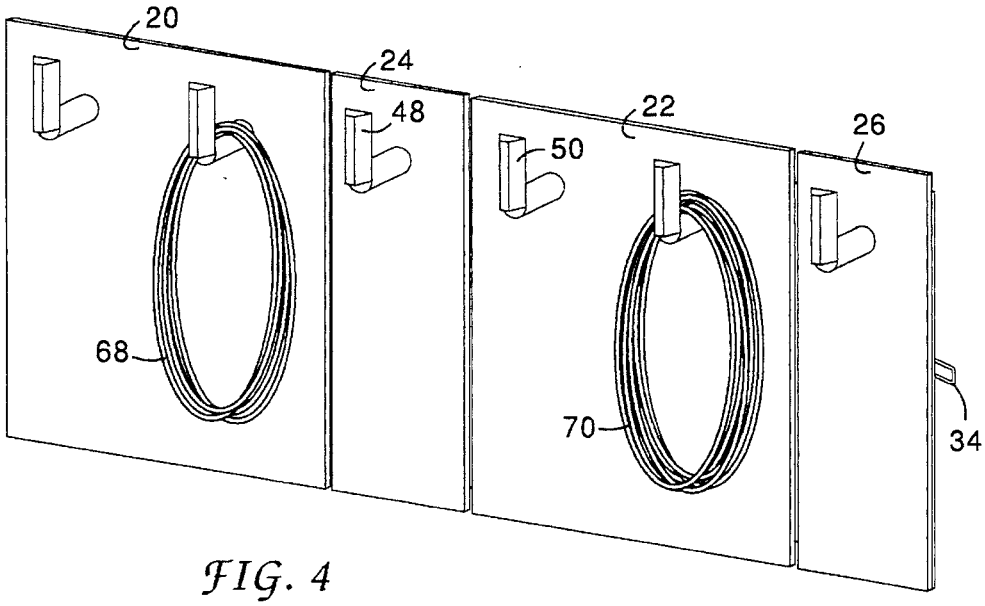
FIG. 4 is an isometric view of the interior walls of the container in the open condition.

The interior of the container is shown in FIG. 4. The latch 34 is open and the top and bottom walls removed. The front, rear and side walls are expanded to a linear panel arrangement. The hooks including previously identified members 48 and 50 extend out and away from the walls 20,22,24, 26 and cable coils 68 and 70 are readily available for use. Obviously, in practical use the hooks will likely all contain wire and many substantially more wire than that shown in the drawing.

Figure 5:
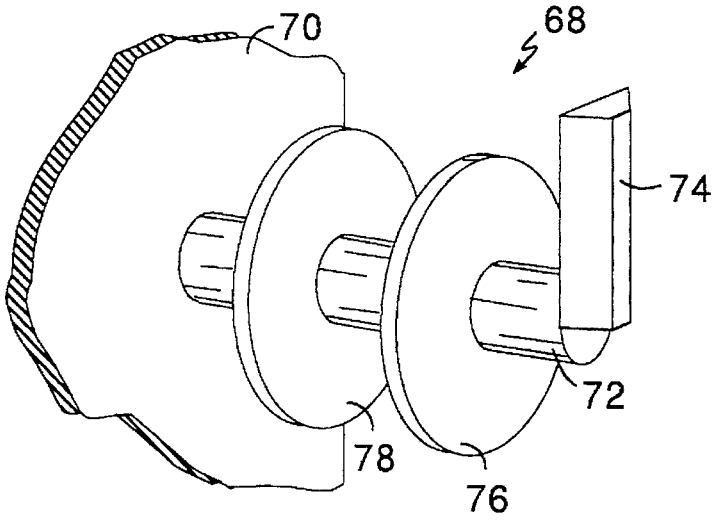
FIG. 5 is an enlarged perspective view of a hook and divider used with the invention.

Concerning FIG. 5, a typical hook is shown generally at 68, attached to the wall 70 in a manner consistent with the invention. Horizontal member 72 extends from the wall to the vertical terminus member 74. Intermittent the wall and member 74 are doughnut shaped members 76,78 which are flexible separator members that aid in organizing the cable on the hook. The separator members have an interference fit over the horizontal member and will slide with some effort in order to increase or decrease the interstitial spacing to accommodate a particular cable bundle.

Figure 6:
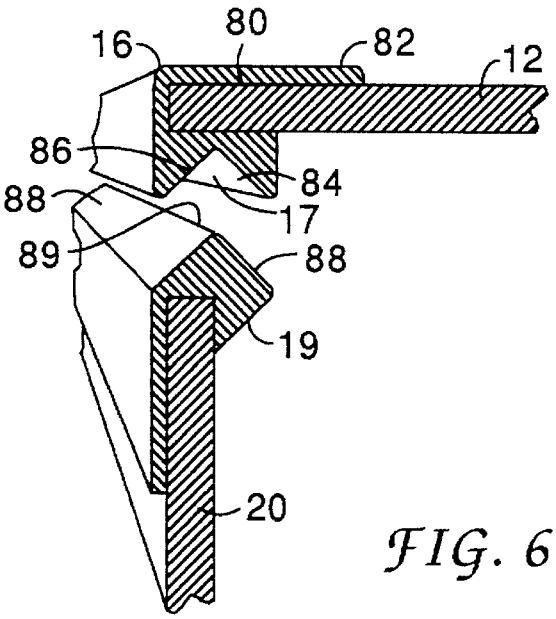
FIG. 6 is a cross sectional view of the stabilizing seal between the sections of the invention.

FIG. 6 shows the detail of one of the edging systems that could be utilized with the container and referred to with regard to FIG. 1. The top panel 12 engages edging member 16 which contains a V-shaped groove 17. Edging member 16 contains an elongated slot 80 that is adapted to receive the top panel 12. An extended lip 82 provides additional frictional force to allow the member 16 to remain in place without the need for additional adhesives or fasteners.

Member 19 engages the side wall 20 in a manner similar to member 16 and panel 12. Member 19 is offset and rectangular in cross section, thereby providing an edge 84 to engage the groove 17. The sides 86 of the V-shaped groove 17 apply a stabilizing force on the walls of the member 19 thereby allowing the interacting sides or top and sides or sides and bottom to become much more rigid when engaged and secured in place. The container, as a result will withstand greater forces from use and abuse than containers of similar size and design. Members 16 and 19 are elongated as shown in the figure and formed from a firm but resilient rubber or plastic material.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A cable transport container comprising: a box like container having a back wall, front wall, side walls, a top wall and a bottom wall where the back, front and side walls are flexibly connected along three abutting edges forming a rectangle and where the front wall and a side wall are releasably secured along the forth abutting edge, and where the top wall abuts the side walls, the front wall and the back wall and is releasably secured to each side wall, and where the bottom wall abuts the side walls, back and front walls and is releasably secured to each side wall; means affixed to each of said releasably secured walls for forming a mating relation with the next adjacent releasably secured wall; end abutting dowels extending from the interior front wall, back wall and side walls on each end of the rectangular container where said dowels are positioned proximate the top wall of said container and adapted to support coils of wire and cable.

2. A cable transport container according to claim 1 wherein: said top wall includes a handle for carrying the container.

3. A cable transport container according to claim 2 wherein: the bottom wall includes a plurality of feet to support the container.

4. A cable transport container according to claim 3 wherein: the means for flexibly connecting each wall of said container is a continuous hinge.

5. A cable transport container according to claim 4 wherein: the top and bottom walls are secured to the front, back and side walls by a plurality of lockable latch mechanisms, engaging a latch catch.

6. A cable transport container according to claim 5 wherein: the said dowels include a hook end.

7. A cable transport container according to claim 6 wherein: the said hook end abuts the top wall.

8. A cable transport container according to claim 7 further including: means mounted on the said dowels for separating cable bundles.

9. A cable transport container according to claim 8 including: a plurality of means for separating mounted on said dowels.

10. A cable transport container according to claim 7 wherein: the means for releasably securing the side wall to the front wall is a lockable latch mechanism engaging a latch catch.

11. A cable transport container according to claim 1 wherein: the means for forming a mating relation is an edging system comprising, a V-shaped groove on one panel and an offset mating ridge having a rectangular cross section on the other panel.

* * * * *